US010597803B2

(12) United States Patent
Weiser et al.

(10) Patent No.: US 10,597,803 B2
(45) Date of Patent: Mar. 24, 2020

(54) COOLING POLYAMIDE YARN

(71) Applicant: NILIT LTD., Migdal Ha'ernek (IL)

(72) Inventors: Alon Weiser, Netanya (IL); Abed Alrahman Zuabi, Nazareth (IL); Uri Afek, Kiryat Tivon (IL)

(73) Assignee: Nilit Ltd., Migdal Ha'Emek (IL)

( * ) Notice: Subject to any disclaimer, the term of this patent is extended or adjusted under 35 U.S.C. 154(b) by 558 days.

(21) Appl. No.: 14/377,458

(22) PCT Filed: Feb. 10, 2013

(86) PCT No.: PCT/IL2013/050122
§ 371 (c)(1),
(2) Date: Aug. 7, 2014

(87) PCT Pub. No.: WO2013/121419
PCT Pub. Date: Aug. 22, 2013

(65) Prior Publication Data

US 2015/0013047 A1 Jan. 15, 2015

(30) Foreign Application Priority Data

Feb. 13, 2012 (IL) ..... 218082

(51) Int. Cl.
*D03D 15/00* (2006.01)
*D01F 6/60* (2006.01)
(Continued)

(52) U.S. Cl.
CPC ..... *D03D 15/00* (2013.01); *D01D 5/12* (2013.01); *D01D 5/22* (2013.01); *D01D 5/253* (2013.01);
(Continued)

(58) Field of Classification Search
CPC .... A41D 13/0053; A41D 31/00; A41B 17/00; Y10T 442/3976; Y10T 428/1362;
(Continued)

(56) References Cited

U.S. PATENT DOCUMENTS 6,010,789 A * 1/2000 Alston ..... D01D 5/253 428/397
6,652,965 B2 11/2003 Merigold et al.
(Continued)

FOREIGN PATENT DOCUMENTS

| | | | |
|---|---|---|---|
| EP | 1188853 | A1 | 3/2002 |
| JP | H08 35145 | A | 2/1996 |
| JP | 2008-285780 | A | 11/2008 |

OTHER PUBLICATIONS

Ebnesajjad, Sina. (2017). Expanded PTFE Applications Handbook—Technology, Manufacturing and Applications—8.1 Introduction. (pp. 171-172). Elsevier. Online version available at: http://app.knovel.com/hotlink/pdf/id:kt0114I0Q6/expanded-ptfe-applications/expanded-p-introduction.*
(Continued)

*Primary Examiner* — Laura C Powers
*Assistant Examiner* — Larissa E Rowe
(74) *Attorney, Agent, or Firm* — Fenwick & West LLP

(57) ABSTRACT

The present invention provides a polyamide (preferably Nylon 66) yarn for weaving or knitting clothes articles which have a cooling effect on the skin of the wearer. The yarn contains an inorganic additive (preferably Titanium dioxide) in an amount of between 0.3 and 3.0 wt % and is characterized by a low crimp modulus and a flat cross section.

5 Claims, 4 Drawing Sheets

(51) Int. Cl.

| | |
|---|---|
| ***D01D 5/253*** | (2006.01) |
| ***D01D 5/12*** | (2006.01) |
| ***D01F 1/10*** | (2006.01) |
| ***D01D 5/22*** | (2006.01) |
| ***D01H 1/115*** | (2006.01) |
| ***D02G 3/04*** | (2006.01) |
| ***D04B 1/16*** | (2006.01) |
| ***A41D 13/005*** | (2006.01) |

(52) U.S. Cl.
CPC ..... *D01F 1/10* (2013.01); *D01F 6/60* (2013.01); *D01H 1/115* (2013.01); *D02G 3/04* (2013.01); *D04B 1/16* (2013.01); *A41D 13/0053* (2013.01); *Y10T 428/2922* (2015.01)

(58) Field of Classification Search
CPC ..... Y10T 428/1018; Y10T 428/249935; Y10T 428/249943; Y10T 428/2922; Y10T 428/3969; Y10T 428/31725; Y10T 442/179; Y10T 442/627; D04B 1/16; D04B 1/20; D03D 15/0088; D03D 5/0083–5/0088; D10B 2331/02; D02G 3/444; D02G 1/00; D02G 3/00–3/02; D02G 3/44; D02G 15/00; D02G 15/0083–15/0088; D02G 3/04–3/047; D01D 5/12; D01D 5/253; D01D 1/065; D01F 1/10; D01F 6/60; D01F 1/02–1/106; D01H 1/115; D06N 2201/0263; C09C 1/3607; C09C 1/0084; C01G 23/047
USPC ..... 428/357, 364–365, 372, 397–402, 428/369–370; 442/189, 192–193, 195, 442/334–337, 352, 356–360
See application file for complete search history.

(56) References Cited

U.S. PATENT DOCUMENTS

| | | | | |
|---|---|---|---|---|
| 6,886,369 | B2 * | 5/2005 | Fukuro | D01D 5/253 66/169 R |
| 2003/0054168 | A1 * | 3/2003 | Merigold | D01D 5/253 428/364 |
| 2004/0237598 | A1 * | 12/2004 | Fukuro | D01D 5/253 66/202 |
| 2005/0221082 | A1 * | 10/2005 | Marlow | D01D 5/082 428/364 |
| 2009/0119822 | A1 * | 5/2009 | Sueto | A41B 17/00 2/400 |
| 2010/0021679 | A1 | 1/2010 | Robert | |
| 2011/0300366 | A1 | 12/2011 | Henssen | |
| 2013/0059495 | A1 * | 3/2013 | Dempster | D02G 1/12 442/181 |

OTHER PUBLICATIONS

European Extended Search Report, European Application No. 13749149.4, dated Sep. 16, 2015, 6 pages.
PCT International Search Report, International Patent Application No. PCT/IL2013/050122, dated Apr. 29, 2013, 7 pages.
PCT Written Opinion, International Patent Application No. PCT/IL2013/050122, dated Apr. 29, 2013, 6 pages.
PCT International Preliminary Report on Patentability, PCT Application No. PCT/IL2013/050122, dated Jan. 29, 2014, 26 pages.
European Office Action, European Patent Application No. 13749147.4, dated Nov. 27, 2018, 5 pages.

* cited by examiner

COOLING POLYAMIDE YARN

FIELD OF THE INVENTION

The present invention relates to a polyamide yarn and fabric, and to articles made therefrom, providing a cooling effect on the skin of the wearer.

BACKGROUND OF THE INVENTION

Polyamide yarns are among the most widely used fibers in the textile industry, the world annual production being about four million tons. Polyamide yarns, like Nylon 6 or Nylon 66, are used in both knitting and weaving with high efficiency to form high quality and fashionable garments. The manufacture of the synthetic fibers like polyamides employs a process of melt spinning, during which the molten polymer is extruded at high pressure and constant rate through a spinnerette into a cooler environment where it solidifies into filaments. Single filaments formed in the spin cells combine in a multifilament continuous yarn, which is eventually textured and wound onto bobbins. Numerous factors which affect the process considerations include the processability of all intermediates during the textile production, equipment wear, general costs, and environmental and safety regards. Among others, considered are the melt viscosity, reuse of leftovers, dyeability of the intermediates, stability of the intermediates during spinning or knitting, design of the final product, etc. Lubricants and finishing oils may be applied to the fibers in the spin cells, and many additives are used to adjust physical, chemical, and esthetic properties of the intermediates and the final products. In the field of polymer yarns, modifications are incessantly sought, which aim not only at improving physical properties like mechanical strength and surface aspect, but also at improving the sensation created by the textile material on the skin of the wearer. However, improving one feature may often lead to a worsening of the other features; for example, when including novel additives, process problems may arise, such as material adherence to the equipment or gas formation. In the complex process, any change effected anywhere between the stage of preparing the polymer and finishing the textile product may lead to unpredictable results. It is an object of the invention to provide a polyamide yarn which will feel pleasant, soft, and cool on the skin of a wearer experiencing increased physical effort or being exposed to higher external temperature. US 2011/0300366 describes a fabric having good resistance against cutting and having thermoregulation properties, composed of two chemically and physically different fibers. It is another object of the invention to provide a fabric which will feel cool on the skin of a wearer experiencing increased physical effort or being exposed to higher external temperature, the fabric comprising one type of polyamide fiber.

It is also an object of this invention to provide a polyamide yarn and fabric which will feel pleasant, soft, and cool on the skin of a wearer, without compromising other physical properties of the polyamide yarn and fabric.

It is further an object of the invention to provide a process for manufacturing a polyamide yarn which will feel pleasant and cool on the skin of a wearer experiencing increased physical effort or being exposed to higher external temperature.

It is a still further object of the invention to provide a process for manufacturing a polyamide yarn which is efficient in lowering a surface temperature of the skin of a wearer exposed to higher temperature.

Other objects and advantages of present invention will appear as description proceeds.

SUMMARY OF THE INVENTION

The present invention provides a yarn to fabric for cooling the skin of a wearer experiencing increased physical effort or being exposed to higher external temperature, the yarn i) comprising polyamide; ii) exhibiting low crimp; and iii) having a flat cross-section. Said polyamide is preferably Nylon 66. Said low crimp is characterized by a crimp modulus of between 1 and 4, and said flat cross-section is preferably characterized by an aspect ratio of between 3:7 and 6:7. Said yarn contains an inorganic additive, preferably homogeneously dispersed in Nylon 66. Said additive is preferably selected from oxides, silicates, sulfates, and their mixtures. In a preferred embodiment, the yarn according to the invention comprises Nylon 66 and an inorganic additive in an amount of from 0.3 wt % to 3.0 wt %. In a preferred embodiment, the yarn has a titer of from 17 dtex to 78 dtex. In other preferred embodiment, the yarn of the invention contains titanium dioxide.

The invention is directed to a polyamide yarn exhibiting low crimp and having a flat cross-section, containing an inorganic additive in an amount of between 0.3 and 3.0 wt % for use in manufacturing clothing articles which are efficient in lowering a surface temperature of the skin of the article wearer.

The invention provides an article comprising a yarn which exhibits low crimp, has a flat cross-section, and contains an inorganic additive in an amount of between 0.3 and 3.0 wt %, selected from underwear, legware, sporting clothes, pantyhose, socks, shirts, working cloth, and other.

The invention aims at providing a process for manufacturing a polyamide fabric for cooling the skin of a wearer experiencing increased physical effort or being exposed to higher external temperature, comprising i) providing a Nylon yarn exhibiting low crimp and having a flat cross-section; and ii) weaving or knitting a fabric or a textile article. Said process comprises, in a preferred arrangement, a spinning step which employs spinning capillaries in the shape of the letter I.

BRIEF DESCRIPTION OF THE DRAWINGS

The above and other characteristics and advantages of the invention will be more readily apparent through the following examples, and with reference to the appended drawings, wherein.

DETAILED DESCRIPTION OF THE INVENTION

Figure 1:
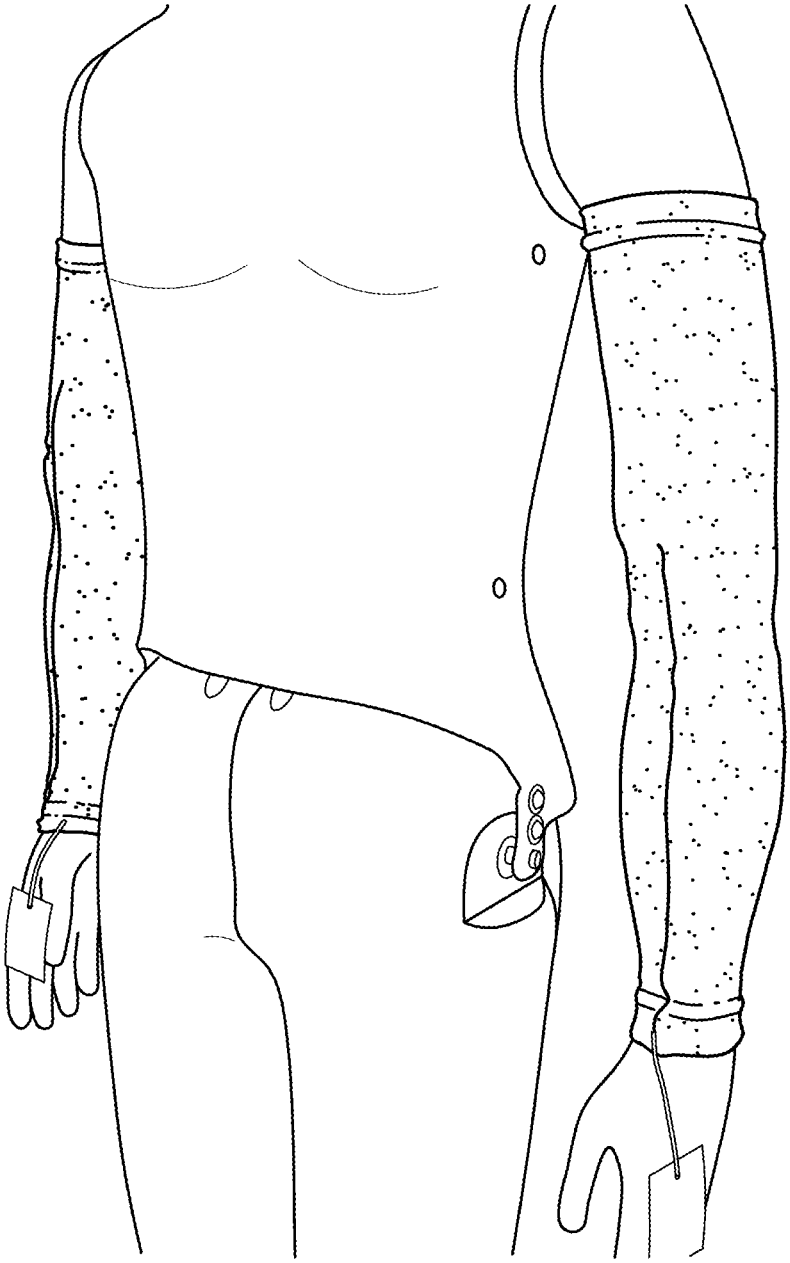
FIG. 1 is a photo of a manikin used for testing a fabric sample according to one embodiment of the invention, the sample being put as a sleeve on the mode's hand.

It has now been found that a Nylon fiber containing an inorganic additive and being structured to have a low crimp and a flat cross-section confers surprisingly efficient ventilation abilities to textile articles to be worn by a person exposed to heat challenge, such as experiencing increased physical effort or being exposed to higher external temperature. The superior cooling properties of apparel knitted of the yarn was confirmed on manikin model.

The invention relates to a special yarn, to fabric comprising then yarn, and to apparel articles comprising said fabric, enabling superior surface cooling on the skin of the wearer, whereas the wear articles are comfortable to touch and feel cool. The cooling effects of the materials according to the invention are confirmed in objective laboratory tests. The yarn is made of polyamide, has a flat or oval cross-section, and has a very low texture degree. The yarn preferably contains Nylon 66 and titanium dioxide dispersed in the Nylon.

The feature of a special texture comprising low crimp combined with the flat cross-section, in a yarn made of Nylon 66 containing an admixture of inorganic additive, provides cooling properties quantized in objective tests. For example, when measured on manikin model, a knitted sample employing 78/68/1 Nylon 66 provided a surface temperature reduction of about 0.5° C.

The crimp modulus is preferably from 1 to 4, whereas usual values are from 6 to 14. The crimp and bulkiness of the yarn according to the invention is lower then in normally textured nylon. A special fiber having a flat cross-section is provided in a special texturing procedure, while employing special settings which does not distort the filament shape and its cross-section is maintained. The instant texturing procedure makes a yarn having a disk configuration of 1-2-1, compared with standard 1-7-1 configuration. A special setting provides for low crimp of the yarn, and for low bulkiness of the textured yarn, and in addition it does not distort too much the original flat cross section of the filaments as it would happen in normal texturing. With normal texturing the effect of the special cross section would diminish. The combination of low crimp and flat cross-section was found to achieve surprising cooling effects during laboratory tests, for a nylon yarn containing an inorganic additive, such as nylon 66 with $TiO_2$.

A low crimp of the nylon fibers was achieved by special texturing conditions. The low crimp is achieved by texturing setting; mainly using the 1-2-1 disk configuration. The special capillary gives the shape of the cross section during spinning. The capillary with I-shape design is employed. Usually, dtex is in the range of 17-78 and the number of filaments in the yarn is 3-68, such as in 78/68/1 yarn. Of course, modifications are employed, for example using 1 ply or 2 ply yarns, and other changes. The elastic properties measurements of the textured yarns was performed in an equipment called Texturmat (TEXTECHNO, Germany), and the crimp modulus was measured as % shrinkage of the textured yarn; the crimp modulus is usually more then 7% in normal yarns, often up to 20% and more.

The yarn according to the invention has a flat cross-section, for example an oval cross-section. The flatness is characterized as aspect ratio throughout the present text. Aspect ratio is the ratio between the minimal linear dimension of the cross-section and its maximal linear dimension; for example, the aspect ratio of an elliptic cross-section would be the ratio between the minor axis and the major axis of the ellipse. The aspect ratio of a yarn according to the invention is usually between 3:7 and 6:7.

The invention aims at providing a special yarn for knitting or weaving a nylon fabric which feels pleasant and cool on the skin of a wearer using a wear article made of said fabric. The invention, thus, relates to a manufacturing process comprising steps of i) providing Nylon, preferably Nylon 66 containing an inorganic additive selected from oxides, silicates, sulfates, or mixtures thereof, in an amount between 0.5 and 5.0 wt %, ii) melt spinning said Nylon while employing a spinneret capillaries with a cross-section shaped as the letter I, iii) knitting or weaving a fabric to be used in making apparel, for example pantyhose, socks, underwear, sport knitted fabrics, working clothes, special sport garments. Said step i) may comprise mixing monomer and $TiO_2$ in an amount of 0.3-1.5% and polymerizing, said step ii) includes spinning the polymer to fiber which is flat in cross-section and low-crimped or not crimped at all, and said step iii) may provide apparels such as hosiery, sportsware, and underwear. The texturing setting is specially adapted to get the required touch and smoothness; for example, trial samples of titer 78/68/1 with different polymers and texturing setting were produced during the development stages and compared to the standard yarns with the same titer; Nylon 66 was preferred; the cooling effect of the yarn/fabric was confirmed by laboratory tests on inanimate model. Said step i) preferably comprises incorporating inorganic additives into the polymer, preferably comprising oxides, and possibly other materials selected from carbonates, silicates, sulfates, wherein the particle size of the inorganic additive may be from 0.1 μm to 2 μm. The fiber shape combined with its chemical composition results in refreshing feeling in human when checked in an actual sensory test, confirmed by laboratory tests on inanimate models. The total effect of the wear article according to the invention results from the structural properties of the fabric, including physical properties of the fiber affecting its heat conductivity and its sensory effects on the skin.

The articles to be made of the yarn according to the invention include, in one embodiment, underwear such as knitted leg-wear and body-wear garment, and sports wear. The invention provides articles, knitted or woven from a flat or low crimp Nylon 66 fiber, which provide excellent feeling on skin touch. The garment according to the invention induces sensation of cool feeling in a wearer using it, and also helps in mitigating heat stress which can occur when the cooling mechanisms of the body cannot by themselves dissipate excessive heat. The yarn and cooling garment according to the invention, thus, help to maintain body temperature within safe levels during physical effort or during exposure to a high external temperature. The articles of the invention will, therefore, be specially useful in sport events or in hot environment. Of course, the articles of the invention may be used in a broad range of situations.

The invention will be further described and illustrated in the following examples.

EXAMPLES

Example 1

Full dull polymer was spun using melt spinning pilot machine to 100 dtex 68 filaments POY yarn. Polymer properties and spinning conditions are in Tables 1 and 2 below. The pilot machine consisted mainly of extruder 4E10/24D made by BARMAG, screw diameter 40 mm. Spinning beam had 4 packs to adapt 90 mm diameter spinneret and BARMAG ACW 1200/6 winder.

Figure 4:
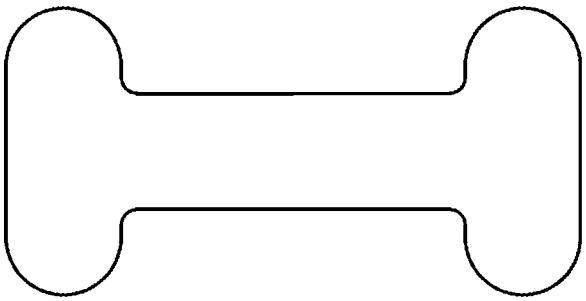
FIG. 4 shows the shape of the spinning capillary in one embodiment of the method according to the invention; the special cross-section of the capillary, in the shape of the letter I, in contrast to the usual round shape capillary, provides the desired yarn filaments cross section.

The spinneret used had 34 special capillaries, and filaments from 2 spinnerets were plied together in order to get the 68 filament yarn. The yarn of the above example was textured on false twist texturing machine under conditions described in table 3. Special capillary in the shape of letter I was used (FIG. 4), instead of usual round shape.

TABLE 1

| Polymer properties: | | |
|---|---|---|
| | | Ascend FD |
| Relative viscosity | RV | 41.5 |
| Amine end groups | Meq/Kg | 57 |
| TiO2 content | % | 1.6 |
| Humidity | Ppm | 1250 |

TABLE 2

| Spinning conditions and POY properties | | | |
|---|---|---|---|
| | | Cooling yarn 100/68 | 100/68 regular FD spec (production machine) |
| Melt temperature | ° C. | 280 | 277 |
| Extruder outlet pressure | Bar | 100 | 120 |
| Spinneret initial pressure | Bar | 230 | 250 |
| Winding speed | m/min | 4500 | 4500 |
| Titer | Dtex | 98.3 | 94.6-99 |
| Elongation | % | 68 | 65-73 |
| Tenacity | cN/dtex | 2.93 | 3 |

TABLE 3

| Texturing conditions | | | |
|---|---|---|---|
| | | 78/68/1 cooling yarn | 78/68/1 regular spec |
| Winding speed | m/min | 567 | 567 |
| Draw ratio | | 1.162 | 1.24 |
| D/Y ratio | | 2.27 | 2.22 |
| Disk configuration | | 1-2-1 | 1-7-1 |
| Heater temperature | ° C. | 190 | 205 |
| Titer | dtex | 86.6 | 79.8-82.2 |
| Tenacity | cN/dtex | 2.43 | 3 |
| Elongation | % | 28.3 | 18-26 |
| Crimp Contraction | % | 6.2 | 23-31 |
| Crimp Modulus | % | 2.6 | 6-14 |
| Crimp Stability | % | 55.9 | 76 |

Example 2

Figure 2:
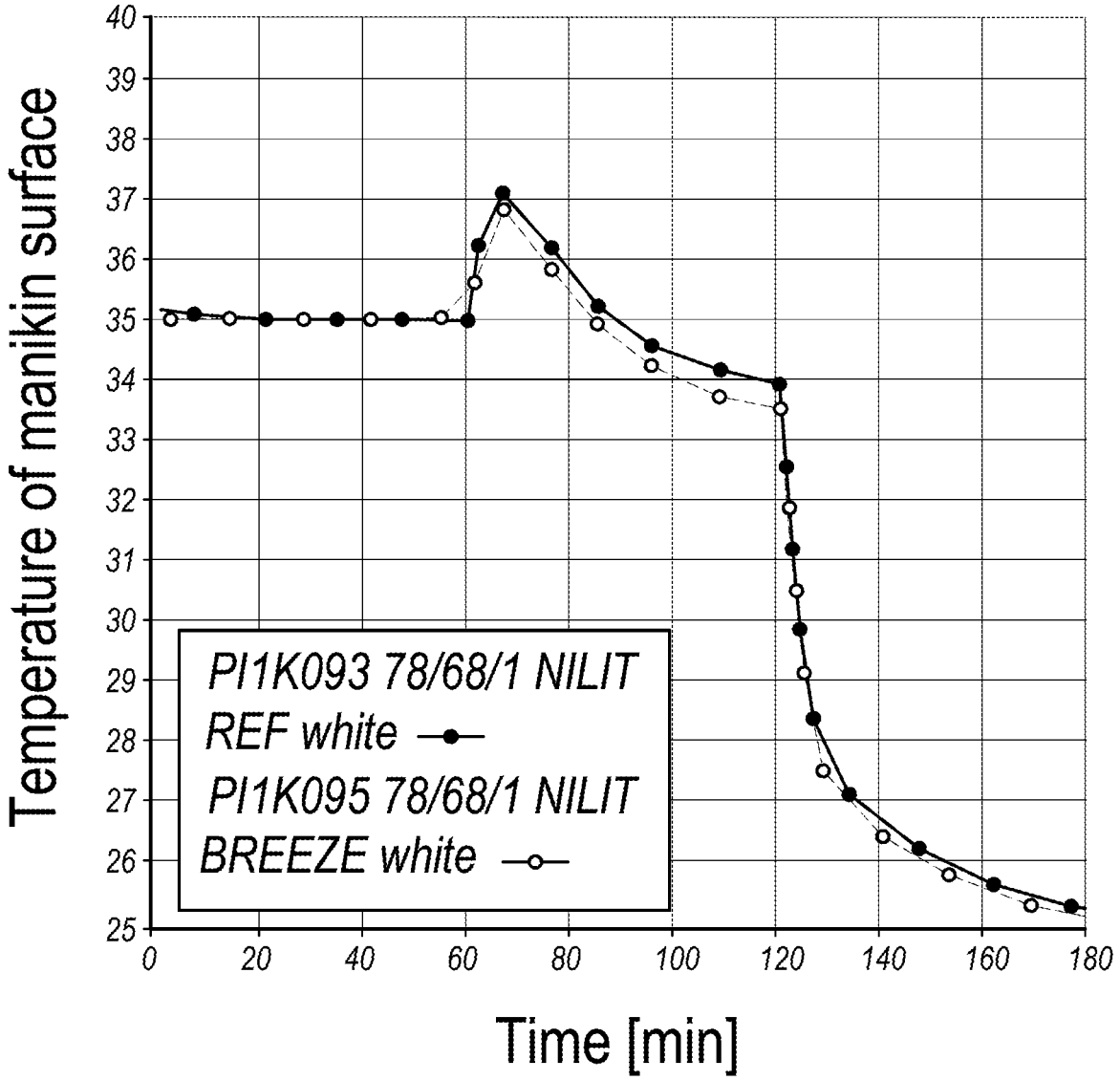
FIG. 2 is a graph showing a temperature course on the surface of a manikin wearing a fabric sample according to one embodiment of the invention (lower curve), compared with a temperature course on the surface of the manikin wearing a comparative fabric sample (upper curve), both samples were of Nilit white Nylon type.
Figure 3:
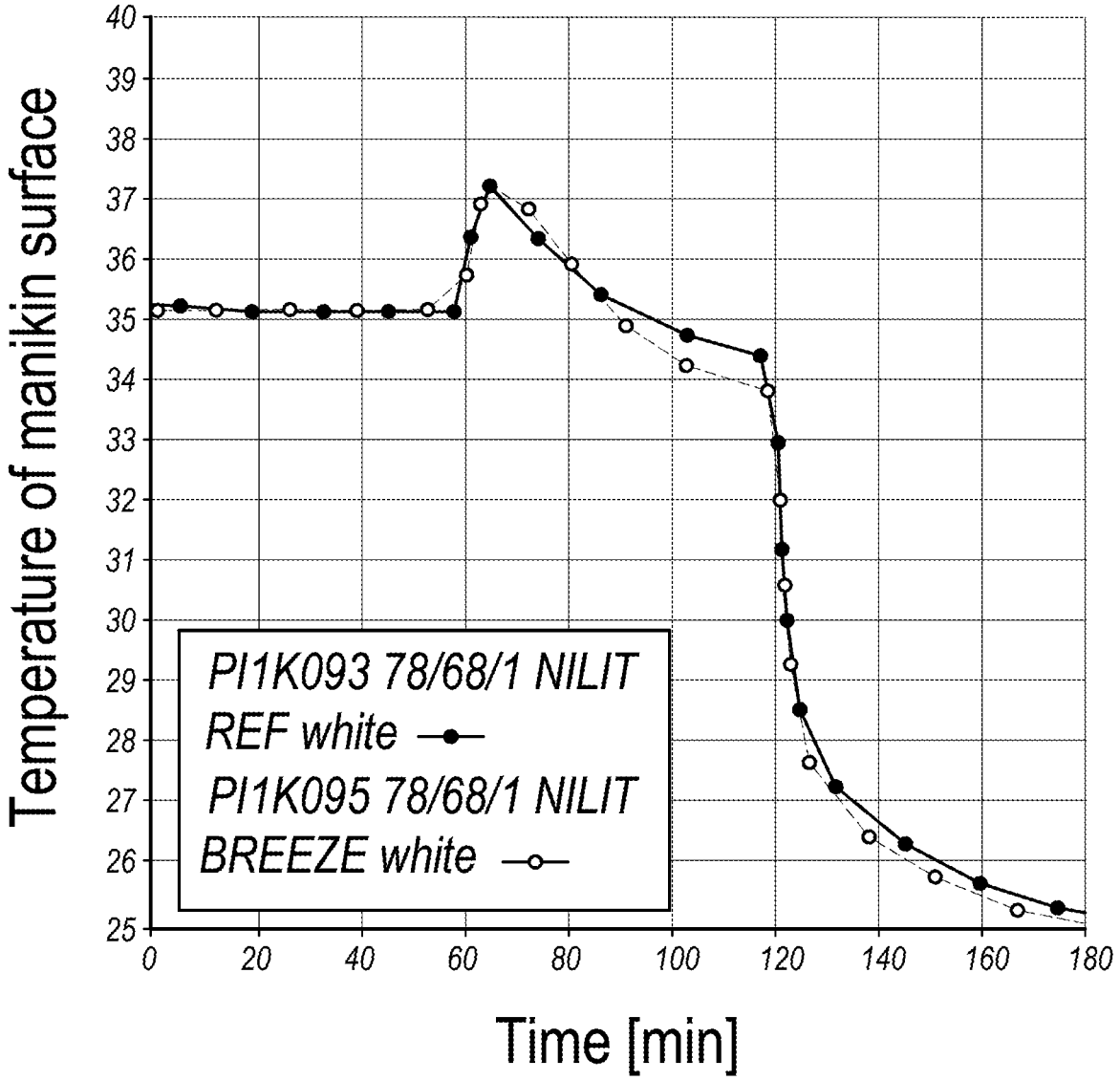
FIG. 3 is a graph showing temperature courses similar as in FIG. 2, in a repeated test, again using samples of Nilit white Nylon type, one sample according to the invention and another one comparative.

The fabric obtained from yarns described in Example 1 was checked on an inanimate model and compared with a reference fabric of Nilit (FIG. 1). The surface temperature of a thermal sweating manikin during simulated exercise and rest phases was measured. Two fabric samples in the shape of sleeves were tightly fitted to the arms of manikin Newton. The sample according to the invention was compared with a reference sample as specified below:

Sample Id. PI1K094 Nilit ref. 78/68/1 NILIT REF blue
Sample Id. PI1K096 Nilit ref. 78/68/1 NILIT BREEZE blue
Sample Id. PI1K093 Nilit ref. 78/68/1 NILIT REF white
Sample Id. PI1K095 Nilit ref. 78/68/1 NILIT BREEZE white Two samples (blue and white fabrics) were compared with reference samples, in two series of experiments, the first series A and the second B. The test conditions were: air temperature of 20° C., relative humidity of 50%, and air velocity of 0.4 m/s. The duration of the test was 3 hours. Table 4 shows test phases and conditions. The first phase is an acclimatization phase at constant temperature and with no sweating. The second phase simulates exercise with high metabolism and sweating. The third phase simulates rest (post exercise) with low metabolism and no sweating. During the test, the surface temperature of the manikin right and left arms was recorded. FIG. 2 shows the temperature courses for test A and FIG. 3 test B, both for "white" samples (two repetitions). The courses for "blue" fabrics were similar (not shown).

TABLE 4

| Manikin test | | | | |
|---|---|---|---|---|
| Time [min] | Phase | Temperature [° C.] | Heat flux [W/m$^2$] | Sweat rate [ml/h/m$^2$] |
| 0 → 60 | Acclimatization | 35 | — | 0 |
| 60 → 120 | Exercise | — | 250 | 200 |
| 120 → 180 | Rest | — | 50 | 0 |

The heat fluxes measured during phase 1 of test A (acclimatization) were as seen in Table 5.

TABLE 5

| Heat fluxes in W/m$^2$ | | |
|---|---|---|
| Test | Reference | Invention |
| A | 150.1 | 152. |
| B | 150.1 | 151.0 |
| Average | 150.1 | 151.5 |

A higher cooling effect can be seen in the fabric according to the invention during phases 2 (exercise) and 3 (rest), when compared to the reference fabric. In test A, the blue product according to the invention provides a surface temperature which was lower by 0.63° C. than the reference product; in test B, the difference was 0.66° C. The temperature reductions in the A and B tests with white fabric were similarly 0.46° C. and 0.6° C.

While this invention has been described in terms of some specific examples, many modifications and variations are possible.

The invention claimed is:

1. A yarn for use in knitting or weaving fabric for a wearer experiencing increased physical effort or being exposed to higher external temperature, the yarn i) consisting of Nylon 66 and titanium dioxide ($TiO_2$), wherein said Nylon 66 is polymerized from a mixture of monomers with $TiO_2$, said $TiO_2$ being present in the yarn in an amount of 0.3 wt % to 1.5 wt %, ii) exhibiting low crimp characterized by a crimp modulus between 2% and 3%, and iii) having an elliptic cross-section characterized by a ratio between a minor axis and a major axis of between 3:7 and 6:7, wherein the combination of the crimp with the ratio and with the chemical composition affects heat conductivity and the structural properties of the fabric knitted or woven from said yarn, resulting in cooling the skin of the wearer, the effects being confirmed and quantized in laboratory tests, and being compared with a comparative fabric sample on an inanimate manikin model.

2. A fabric knitted or woven solely from one type of a yarn according to claim 1.

3. An article comprising a yarn according to claim 1, selected from underwear, sporting clothes, hosiery, socks, shapers, shirts, working cloth, sports wear, suits, and trousers.

4. A process for manufacturing a fabric for cooling the skin of a wearer experiencing increased physical effort or being exposed to higher external temperature, comprising i) providing a yarn according to claim 1; and ii) weaving or knitting a fabric or a textile article.

5. A process according to claim 4, wherein said step of providing the yarn comprises spinning Nylon 66 fibers while using spinning capillaries in the shape of the letter I.

* * * * *